United States Patent [19]

Baumgarten

[11] 4,242,037

[45] Dec. 30, 1980

[54] GRIPPING TOOL, PARTICULARLY FOR HANDLING TIMBER

[75] Inventor: Börje N. V. Baumgarten, Hassela, Sweden

[73] Assignee: Hiab-Foco AB, Sweden

[21] Appl. No.: 44,194

[22] Filed: May 31, 1979

[30] Foreign Application Priority Data

Jun. 27, 1978 [SE] Sweden ..... 7807249

[51] Int. Cl.[3] ..... B66C 3/16

[52] U.S. Cl. ..... 414/739; 294/88; 294/106; 414/722

[58] Field of Search ..... 414/722, 729, 718, 731, 414/732, 734, 738, 739; 294/88, 86 R, 106

[56] References Cited

U.S. PATENT DOCUMENTS

| | | | |
|---|---|---|---|
| 3,069,761 | 12/1962 | Sommer | 294/86 R X |
| 3,359,033 | 12/1967 | Curtis | 294/88 |
| 3,413,029 | 11/1968 | Donovan | 294/86 R X |
| 3,438,523 | 4/1969 | Vik | 294/88 X |

FOREIGN PATENT DOCUMENTS

| | | | |
|---|---|---|---|
| 1531216 | 3/1970 | Fed. Rep. of Germany | 294/106 |
| 178302 | 1/1966 | U.S.S.R. | 294/88 |
| 416304 | 7/1974 | U.S.S.R. | 294/106 |

*Primary Examiner*—Stephen G. Kunin
*Assistant Examiner*—Terrance L. Siemens
*Attorney, Agent, or Firm*—Newton, Hopkins & Ormsby

[57] ABSTRACT

A gripping tool, particularly intended to be fitted on the jib of a crane. The tool comprises a support member and gripping jaws arranged to pivot towards and away from one another relative to said support member. By means of connecting rods 25 the gripping jaws are removably secured in pairs to the ends of two tubular shafts and are arranged to pivot jointly in opposite directions about coaxial shaft journals on the support member. Each gripping jaw is provided with a laterally directed hub sleeve having a non-round cross-sectional shape. The hub sleeves are arranged for insertion into the ends of the tubular shafts.

4 Claims, 5 Drawing Figures

GRIPPING TOOL, PARTICULARLY FOR HANDLING TIMBER

BACKGROUND OF THE INVENTION

The kind of gripping tool, intended for timber handling and carried by a crane jib, that is available on the market to-day, is manufactured from a number of sheet-metal components which are welded together by means of conventional manufacturing methods. Gripping tools of this kind are rather complicated in structure and for this reason expensive to manufacture, since a large number of sheet-metal components must be manufactured and joined by welding, which is very time-consuming.

One method of manufacturing gripping tools, which provides considerable advantages over prior-art methods, is to manufacture the tool through casting. This method makes it possible to distribute the steel material over the various parts of the gripping tool in a manner that is more advantageous with regard to strength. One consequence is lower weight while at the same time bearing lugs or hubs and other details may be formed in the casting operation proper without entailing additional costs. An added advantage is that is becomes possible to utilize a low cost system of exchanging the various units incorporated in the tool.

SUMMARY OF THE INVENTION

The advantages outlined above are obtained in accordance with the subject invention in a gripping tool of the kind comprising gripping jaws that are pivotable towards and away from one another relative to the gripping tool support member. More precisely, the characterising features of the invention reside in the provision of connecting rods by means of which the gripping jaws may be removably secured in pairs to the ends of two tubular shafts, and in the arrangement of the gripping jaws in such a manner that they pivot jointly in opposite directions about coaxial shaft journals provided on the gripping tool support member. In addition, each gripping jaw isprovided with a laterally directed hub sleeve with a non-round cross-sectional shape, which hub sleeves are arranged for insertion into correspondingly shaped ends of the respective tubular shafts. In a gripping tool of this kind, which in service is often over-loaded and exposed to rough handling, replacement of the gripping jaws that are damaged or deformed may be effected easily and conveniently.

In accordance with a preferred embodiment of the invention, the gripping jaws are provided with a conically tapering and laterally directed hub sleeve, said sleeve having a non-round cross-sectional shape, such as a polygonal shape. The tube sleeve is arranged to be inserted into the associated tubular shaft, into the end thereof that has a shape corresponding to that of the sleeve. Owing to this shape of the sleeve and the associated end of the respective tubular shaft, an extremely strong bond between the tubular shaft and its associated gripping jaw is obtained when the connecting rods are tightened. The connecting rod which is strained through this tightening, provides a yielding tensile force which allows minor sagging in the contacting surfaces of the tubular shaft ends and the gripping jaw hub sleeve without reduction of the prestressing force in the connection rod. As a consequence the requirements on surface and shape of these components may be reduced. The case with which the gripping jaws may be replaced offers the added advantage that the tool may be fitted with gripping jaws of smaller or larger size, depending on need, in addition to which it likewise becomes possible to mount the jaws in different initial positions, thus adapting the tool to particular tasks.

BRIEF DESCRIPTION OF THE DRAWINGS.

The invention will be described in closer detail in the following with reference to the accompanying drawings, wherein.

DETAILED DESCRIPTION OF A PREFERRED EMBODIMENT

Figure 1:
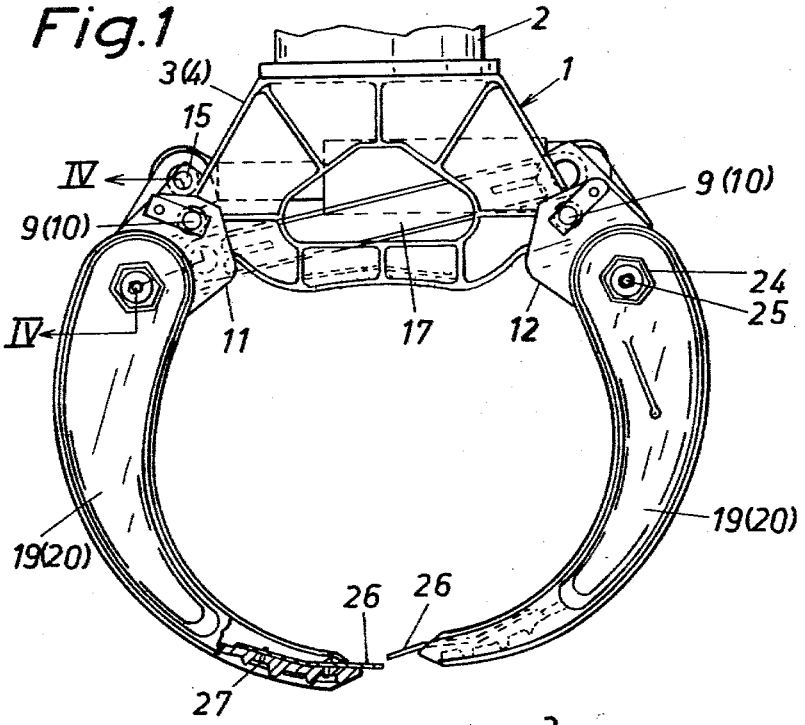
FIG. 1 is an end view of a gripping tool in accordance with the invention, the tool being shown in its operative position wherein the gripping jaws are closed.
Figure 2:
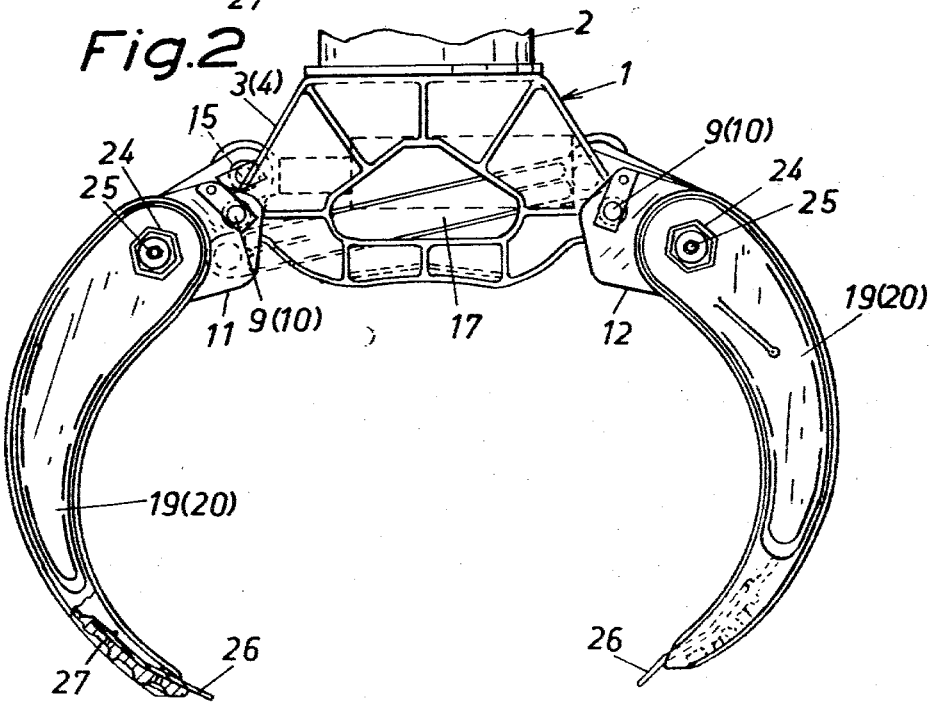
FIG. 2 is a similar view, showing the gripping jaws in open, spread-apart position.
Figure 3:
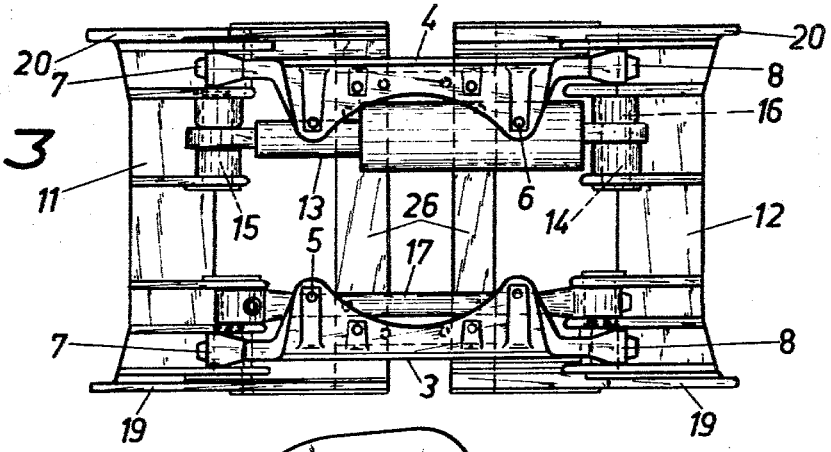
FIG. 3 is a plan view of the gripping tool.
Figure 5:
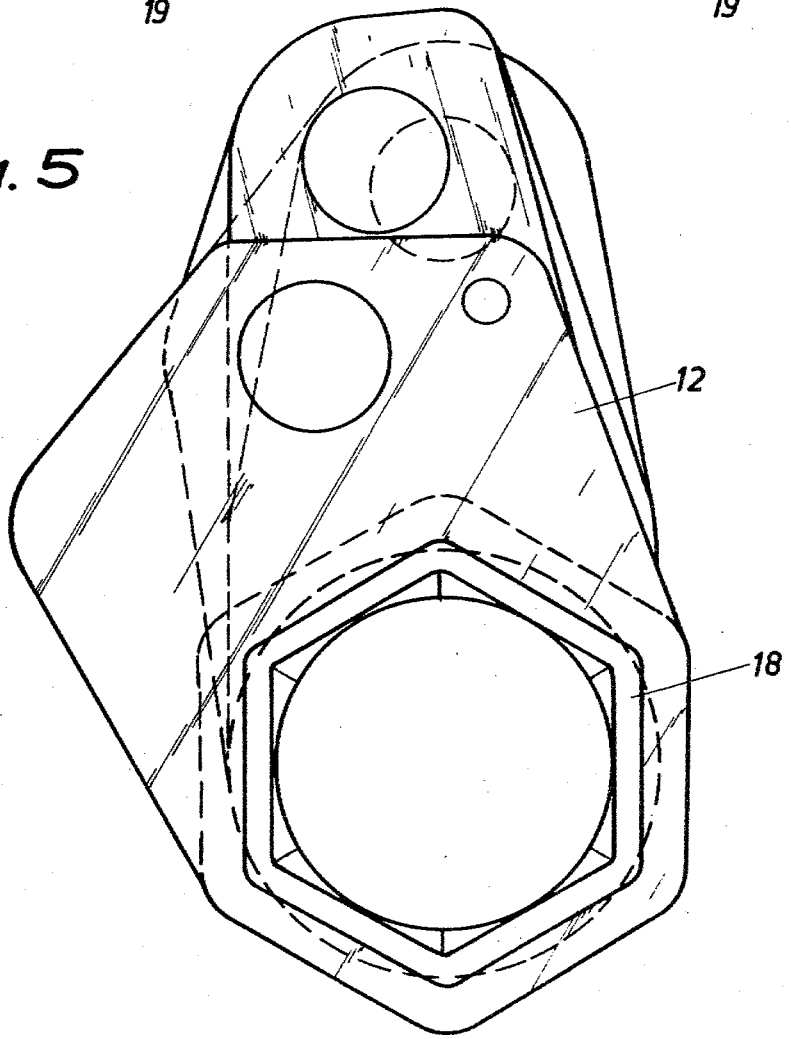
FIG. 5 illustrates on an enlarged scale an end view of one of the two tubular shafts of the gripping tool.
Figure 4:
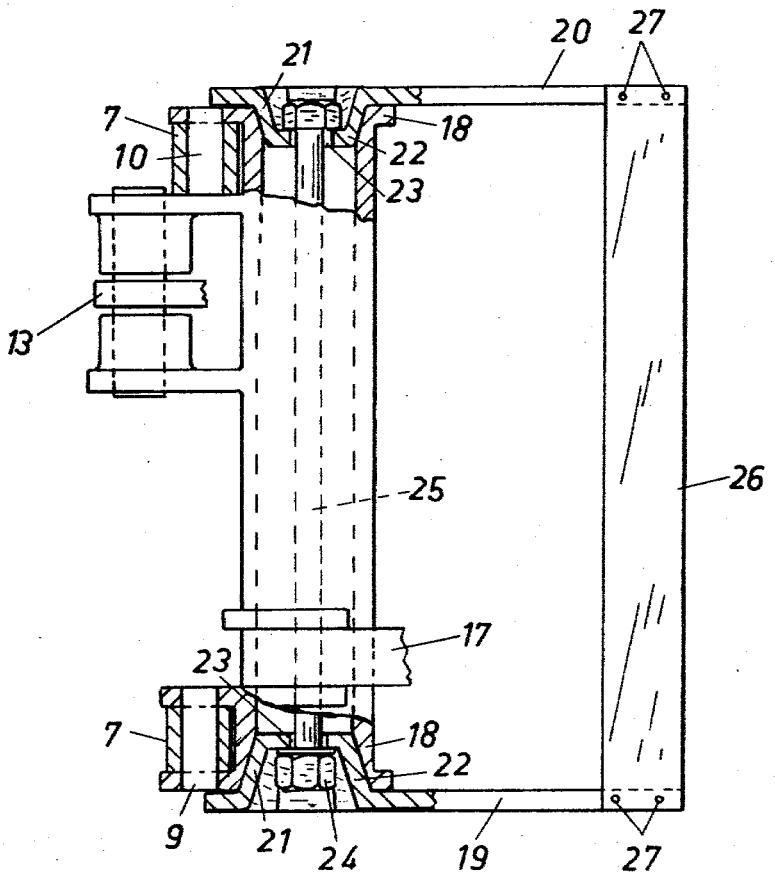
FIG. 4 is a vertical longitudinal sectional view through the gripping tool as seen along line IV—IV of FIG. 1.

The gripping tool 1 illustrated in the drawings, which is designed to handle timber, is intended to be suspended from a rotating unit 2 positioned at the outer end of a crane jib (not shown). The support member 3, 4 of the gripping tool is provided at its upper part with a number of apertures 5, 6 through which pass bolts (not shown) provided to secure the gripping tool 1 to the rotating unit 2. The support member 3, 4 is provided with bearing lugs or hubs 7, 8 through which pass coaxial shaft journals 9, 10. Two tubular shafts 11, 12 are arranged for pivotal movement about its respective one of said shaft journals 9, 10 by means of an hydraulically operated piston-and-cylinder unit 13, 14. The latter is mounted between two pins 15 and 16 on the respective tubular shafts 11 and 12. Intermediate the tubular shafts 11, 12 is likewise arranged a parallelism rod 17 forcing the tubular shafts to turn simultaneously and to the same extent in mutually opposite directions.

The tubular shafts 11, 12 widen conically at their ends 18, their cylindrical cross-sectional shape passing into a polygonal cross-sectional shape. At the ends 18 of the respective shafts 11, 12 are arranged gripping jaws 19, 20. Each gripping jaw 19, 20 is provided with a laterally directed hub sleeve 21 which tapers conically towards its free end and has a polygonal cross-sectional shape matching the cross-section of the ends 18 of the tubular shafts 11, 12. At its free end each sleeve-like hub 21 is provided with a bottom portion 22. The latter is formed centrally with an aperture 23 through which passes a connecting rod 25 provided with a nut 24.

It is obvious that on account of the polygonal shape chosen for the ends 18 of the tubular shafts and the hub sleeves 21 and extremely secure bond between the tubular shafts 11, 12 and their respective gripping jaws 19, 20 is obtained when the nut 24 is tightened.

The ends of the gripping jaws 19, 20 are interconnected in pairs by a steel rail 26 secured to the jaws 19, 20 by means of screws 27, allowing the rail 26 to be exchanged, whenever necessary.

The shape of the support member 3, 4 of the gripping tool 1 as well as that of the gripping jaws 19, 20 may be modified and altered in a variety of ways within the scope of the invention.

What I claim is:

1. An improved gripping tool, particularly intended to be fitted on the jib of a crane, said gripping tool comprising gripping jaws which are arranged to pivot towards and away from one another relative to a gripping tool support member, the improvement comprising two tubular shafts, connecting rods by means of which said gripping jaws are removably secured in pairs to said two tubular shafts, coaxial shaft journals provided on said gripping tool support member, said gripping jaws arranged so as to pivot jointly in opposite directions about said coaxial shaft journals, a laterally directed hub sleeve on each one of said gripping jaws, said hub sleeves having a non-round cross-sectional shape and arranged for insertion into a correspondingly shaped end of the associated tubular shaft.

2. An improved gripping tool as claimed in claim 1, wherein said hub sleeves taper conically towards their free ends, the ends of said tubular shafts having a corresponding internal conical shape, widening towards the free shaft ends.

3. An improved gripping tool as claimed in claim 2, comprising a bottom section formed at the free end of each one of said hub sleeves, a central aperture in said bottom section, a connecting rod provided with a nut passing through said central aperture in said oppositely directed hub sleeves.

4. An improved gripping tool as claimed in claim 2, comprising an exchangeable steel rail interconnecting the free ends of the gripping jaws of each tubular shaft.

* * * * *